US006036007A

United States Patent [19]

Alejandro et al.

[11] Patent Number: 6,036,007

[45] **Date of Patent: *Mar. 14, 2000**

[54] TRANSPORTATION CASE FOR A HEAVY OBJECT

[76] Inventors: Miriam L. Alejandro; Jan M. Alejandro, both of 3007 Santa Rosa Ave., Altadena, Calif. 91001; Raymond L. Ward, 1648 Borden St., San Mateo, Calif. 94403

[ * ] Notice: This patent issued on a continued prosecution application filed under 37 CFR 1.53(d), and is subject to the twenty year patent term provisions of 35 U.S.C. 154(a)(2).

[21] Appl. No.: 08/700,672

[22] Filed: Aug. 8, 1996

[51] Int. Cl.[7] ..... B65D 85/02

[52] U.S. Cl. ..... 206/303; 53/409; 206/493; 206/511; 206/523; 220/4.24

[58] Field of Search ..... 206/521, 493, 206/523, 588, 303, 508, 509, 511, 585, 335, 524, 310; 53/467, 475, 452, 409; 220/1.5, 632, 636, 4.24

[56] References Cited

U.S. PATENT DOCUMENTS

| | | | |
|---|---|---|---|
| 2,816,685 | 12/1957 | Schaeffer | 220/632 |
| 3,190,577 | 6/1965 | Allen et al. | 220/4.24 |
| 3,217,919 | 11/1965 | Long et al. | 206/511 |
| 3,252,568 | 5/1966 | Steidinger | 220/4.24 |
| 3,521,764 | 7/1970 | Loomis | 206/509 |
| 3,596,822 | 8/1971 | Holley | 206/303 |
| 3,608,990 | 9/1971 | Arlitt | 206/335 |
| 3,980,185 | 9/1976 | Cain | 220/1.5 |
| 4,339,039 | 7/1982 | Mykleby . | |
| 4,557,383 | 12/1985 | Arnoux et al. . | |
| 4,620,633 | 11/1986 | Lookholder | 206/524 |
| 4,736,861 | 4/1988 | Basili | 220/632 |
| 4,790,430 | 12/1988 | Thomas | 206/303 |
| 4,856,655 | 8/1989 | Barsky | 206/524 |
| 5,007,536 | 4/1991 | Huebner et al. | 220/4.24 |
| 5,048,679 | 9/1991 | Thomas | 206/303 |
| 5,127,520 | 7/1992 | Thomas | 206/303 |
| 5,370,229 | 12/1994 | Kroeckel . | |
| 5,390,797 | 2/1995 | Smalley et al. . | |
| 5,431,970 | 7/1995 | Brown et al. . | |
| 5,469,961 | 11/1995 | Chang | 206/509 |
| 5,609,249 | 3/1997 | Cheng | 206/310 |

OTHER PUBLICATIONS

The BTA Solution Series vol. 1 Aircraft Brakes.
The "Clamshell" Brake Container—BTA–4001, 5001 & 6001 Series.
The Heavy Duty Brake "QUBE–tainer"—BTA–8001 Series.
The Round Brake Shipper—BTA–1001 and 2001 Series.
One Photo of the Airbus Brake.
One Photo of the Texas Trunk.

*Primary Examiner*—Paul T. Sewell
*Assistant Examiner*—Luan K. Bui
*Attorney, Agent, or Firm*—Birdwell & Janke, LLP

[57] ABSTRACT

A transportation case for a heavy object. A top portion and a mating bottom portion, are proven to be the bottom portion having a lesser height than the top portion to minimize lift-over height into the bottom portion. The bottom portion employs a substantially frusto-conically shaped cushion projecting upwardly therefrom, toward the top portion. The top portion employs a similar frusto-conically shaped cushion projecting downwardly therefrom, toward the bottom portion, the cushions being substantially aligned. The cushions are adapted to be partially inserted into respective apertures in the heavy object, such as, in an aircraft brake assembly. The bottom portion provides for attachment of a removable skid on an exterior surface thereof, the top portion having a corresponding recess for receiving the skid of another transportation case stacked thereon. The top and bottom portions are formed of a double-walled plastic shell, the shell being filled between the walls with a plastic foam, to provide for impact and shock resistance.

26 Claims, 4 Drawing Sheets

TRANSPORTATION CASE FOR A HEAVY OBJECT

BACKGROUND OF THE INVENTION

This invention relates to transportation cases, particularly for carrying heavy items. More particularly, this invention relates to transportation cases for shipping a multitude of different sizes of aircraft brake assemblies via a common carrier.

A number of difficulties are encountered in providing a transportation case for shipping a heavy object by a common carrier, such as a truck or aircraft. The transportation case must be strong enough to support a heavy object during the accelerations encountered during shipping and, if the object is also fragile, the case must be sufficiently shock resistant to resist the effects of impacts as well. And it is especially important when shipping objects that are both heavy and fragile, that ease of loading the object into and unloading the object from the container, as well as ease of carrying the loaded transportation case, is provided so as to prevent damage to the object as well as the surroundings, and so as to prevent injury.

The transportation case should resist any contaminants that might emanate from the object. This is particularly important when shipping mechanical parts employing a reactive hydraulic fluid which may leak therefrom. The means for securing the object within the case should be easy to employ and, in particular, should be lightweight so that they are easy to manipulate. And, although especially difficult to provide when transporting a heavy object, the case and the means for securing the object therein should be as lightweight as practical so as not to add appreciably to the shipping weight. Finally, if a specialized means for loading the object into or removing the object from the case is employed, the case must be adapted to suit.

In addition, where a plurality of transportation cases are employed, the shipping cases are often stacked, one on top of the other, either before loading, as loaded, or after unloading. However, especially while stacked as loaded on a moving carrier, the stacked cases are subject to undesirable and, sometimes dangerous, instability. Further, transportation cases are often subject to extreme physical abuse and wear, particularly when stacked on top of one another.

Moreover, it is especially desirable that, if the object is one of a multitude of different sizes of that type of object, one transportation case provide for accommodating all of the sizes. In particular, where aircraft brake assemblies are to be shipped via aircraft, the case must be capable of accommodating multiple sizes of different brakes wherein the brakes may weigh about 500 pounds or more. Especially since the brakes often have fragile internal parts, the case must insulate the brakes from impacts. It should also be resistant to aircraft brake fluid and be capable of withstanding temperatures ranging from −40 to 160 degrees Fahrenheit encountered during world-wide shipping in common carriers such as planes, trains, trucks and ships.

Typical prior art cases for transporting heavy objects are often themselves heavy and employ heavy securing means for securing the object therein. And, often, the securing means is awkward to use because it requires complex manual operation and adjustment as well as being bulky and heavy.

A prior art case specifically adapted to transport aircraft brake assemblies provides for carrying the substantially cylindrical brake assembly in a horizontally disposed orientation, so that the cylindrical axis is parallel to the ground. However, aircraft brake loading and unloading equipment is adapted to pick up and place the object from a configuration in which the object lies with its cylindrical axis upright. Therefore, cases such as these require that the object be moved into and out of its upright configuration outside the case.

Some prior art cases adapted for transporting heavy objects having an aperture therethrough provide a threaded metal rod adapted to be inserted through the aperture, the threaded metal rod hooking or fastening to a bottom surface and receiving at its other end a threaded cap to force the object down against the bottom surface. But the metal rod poses a danger to internal parts that may be accessible through the aperture. In particular, aircraft brake assemblies include internal parts that may be damaged by such a threaded rod extending through the brake bore. In addition, the rod does not provide substantial resistance to lateral movement of the brake within the case. Such movement can damage the brake to the point of making it unserviceable.

Moreover, where such a rod is integral to the case, when the rod is bent or otherwise damaged to the extent it does not function properly, the entire case becomes unserviceable and must be discarded.

Finally, all known prior art cases require manual adjustment of a hold-down mechanism in order to secure the brake to the case.

Accordingly, there is a need for a novel and improved transportation case for a heavy object that provides for increased ease of use, strength, resistance to shock and environmental conditions, ease of loading, unloading and carrying, improved serviceability and flexibility to accommodate various sizes of a heavy object to be transported, as well as provides for decreased weight and cost.

SUMMARY OF THE INVENTION

The improved transportation case for a heavy object of the present invention solves the aforementioned problems and meets the aforementioned need by employing a top portion and a bottom portion, wherein the bottom portion employs a frusto-conically shaped form projecting upwardly therefrom, toward the top portion. The top portion preferably employs another, removable, frusto-conically shaped cushion projecting downwardly therefrom toward the bottom portion, the frusto-conically shaped forms being substantially aligned. The frusto-conically shaped forms are adapted to be inserted partially into an aperture through the heavy object, such as, in an aircraft brake assembly, the bore for receiving the axle. The respective frusto-conically shaped forms provide an interference fit with the circumferential edge of the associated apertures. Preferably, the top portion and the bottom portion have substantially the same width and length, but the bottom having a smaller height, to minimize the lift-over height into the bottom portion and therefore the stress on a user placing a heavy object therein. Different height top and bottom portions and different sized frusto-conically shaped forms contribute to modularity.

The bottom portion provides for attachment of removable skids on an exterior surface thereof, the top portion having a corresponding recess for receiving the skid of another transportation case stacked thereon. The top portion is adapted to matingly clasp to the bottom portion via latches, the top portion mating to the bottom portion along respective circumferential edges. The top and bottom portion are particularly adapted to insulate the contents from vibration and shock. The top and bottom portions are formed of a double-walled plastic shell, preferably formed of high density cross-linked polyethylene, the shell being filled between the walls with a plastic foam, preferably rigid polyurethane.

Therefore, it is a principal object of the present invention to provide a novel transportation case for a heavy object.

It is another object of the present invention to provide such a transportation case which accommodates a multitude of different sizes of the object within a single exterior size and shape.

It is yet another object of the present invention to provide such a transportation case which accommodates the multitude of different sizes of the object while preventing movement within the case during transportation.

It is still another object of the present invention to provide such a transportation case which provides for increased ease of employment, including ease of loading, unloading and carrying the transportation case.

It is a further object of the present invention to provide such a transportation case which requires no manual adjustment to fit different sized objects.

It is yet a further object of the present invention to provide such a transportation case which provides for increased shock resistance.

It is still a further object of the present invention to provide such a transportation case which provides for increased stability when stacked.

It is another object of the present invention to provide such a transportation case which provides for modular part replacement.

It is still another object of the present invention to provide such a transportation case which provides for improved strength to weight characteristics.

It is yet another object of the present invention to provide such a transportation case which provides for decreased cost.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1:
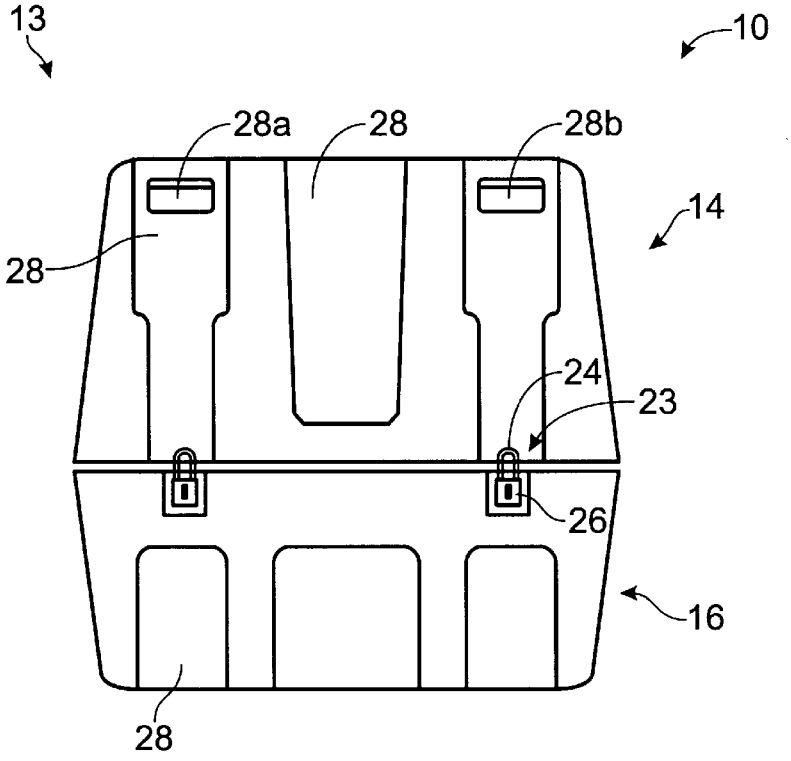
FIG. 1 is a side elevation of a transportation case for a heavy object according to the present invention.
Figure 2:
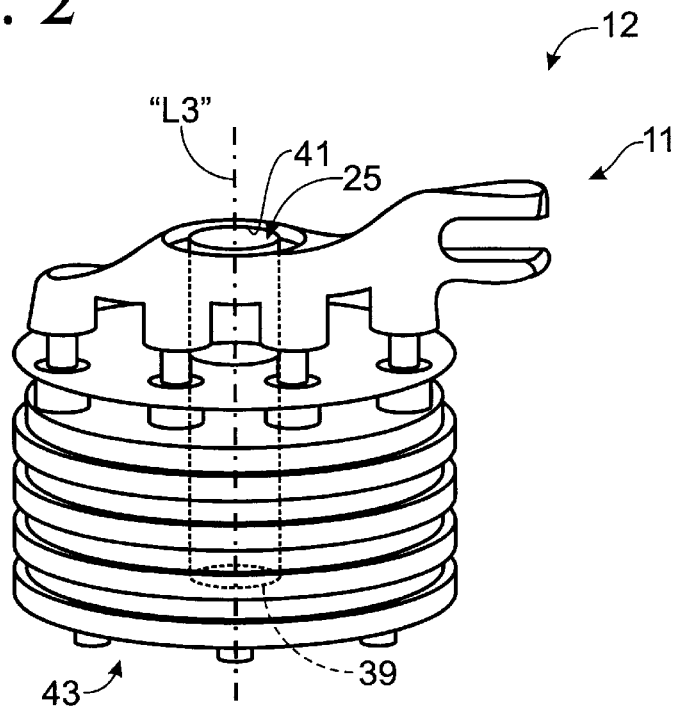
FIG. 2 is a pictorial view of an aircraft brake assembly for which the transportation case of FIG. 1 is particularly adapted.

Referring especially to FIGS. 1, 2, 3, 4 and 5, a preferred embodiment of a transportation case 10 for a heavy object, particularly an aircraft brake assembly 12, comprises a top portion 14 and a bottom portion 16. The top portion and bottom portions include respective circumferential edges 18*a*, 18*b*, which mate with one another in tongue and groove fashion when the case 10 is in a closed configuration 13. In the preferred embodiment, a tongue 15*a* in the bottom portion 16 mates with a suitably sized groove 15*b* in the top portion 14. However, the relative positions of the tongue 15*a* and groove 15*b* may be reversed, or no tongue and groove may be employed, without departing from the principles of the invention.

The portions enclose respective cavities 20*a*, 20*b* which are accessed through openings 22*a*, 22*b* formed by the edges 18*a*, 18*b*. The top and bottom portions include interior surfaces 32*a*, 32*b*, defined by the interior of the cavities 20*a*, 20*b*, and exterior surfaces 34*a*, 34*b*, defined by the exterior of the cavities. Preferably, the portions are substantially rectangular. The brake assembly 12 is placed into the bottom portion 16 for shipping and the top portion 14 is placed thereover to form the closed configuration.

The bottom portion is advantageously provided to be shallower than the top portion, so that the circumferential edges 18*a*, 18*b* meet in the closed configuration at an elevation that is biased toward a lower portion 22 of the case 10. This provides for a decreased lift-over height when placing the brake assembly 12 into the bottom portion 16. Moreover, a bottom 21 of the interior surface 32*b* may be elevated substantially with respect to a bottom 48 of the exterior surface 34*b*, further decreasing the lift-over height and being appropriate for some brake assemblies.

The top portion 14 and the bottom portion 16 employ complementary clasp mechanisms 23. The clasp mechanisms are typical in the art and may include a hook 24, and a loop and cam-over mechanism 26 for clamping the loop over the hook 24. Preferably, the loop and cam-over mechanism 26 is attached to the bottom portion 16 while the hook 24 is attached to the top portion 14. Other clasp mechanisms may be employed without departing from the principles of the invention.

The top and bottom portions 14 and 16 employ recesses 28 which provide stiffening of the case 10. The top portion 14 includes hand-holds 28*a* and 28*b* for removing and replacing the top portion 14 from the bottom portion 16, and for carrying the case 10, particularly when the case is empty.

The bottom portion 16 includes a bottom cushion 36 projecting toward the top portion 14 when the case 10 is in the closed position 13. Thence, the bottom cushion projects substantially upwardly from the interior surface 32*b*. The bottom cushion 36 is rigidly attached to the bottom portion and, preferably, is integrally formed therewith. The bottom cushion is advantageously located so that an elongate axis "L1" thereof emanates from a substantially central position within the cavity 20*b* for heavy objects that are aircraft brake assemblies. However, the cushion 36 may be located at other positions determined to be advantageous for particular heavy objects without departing from the principles of the invention. Moreover, for objects 12 that are aircraft brake assemblies, the axis "L1" is advantageously aligned with an elongate axis "L3" of the brake assembly, shown in FIG. 2.

The bottom cushion 36 is elongate, the elongate axis "L1" being disposed so as to be substantially perpendicular to a surface of the heavy object which is received thereby. For a substantially rectangular cavity 20*b* receiving an aircraft brake assembly, the axis "L1" of the bottom cushion is substantially perpendicular to the bottom 21 of the surface 32*b*. However, other orientations may be desirable for other objects and other case configurations and may be employed without departing from the principles of the invention.

Figure 4:
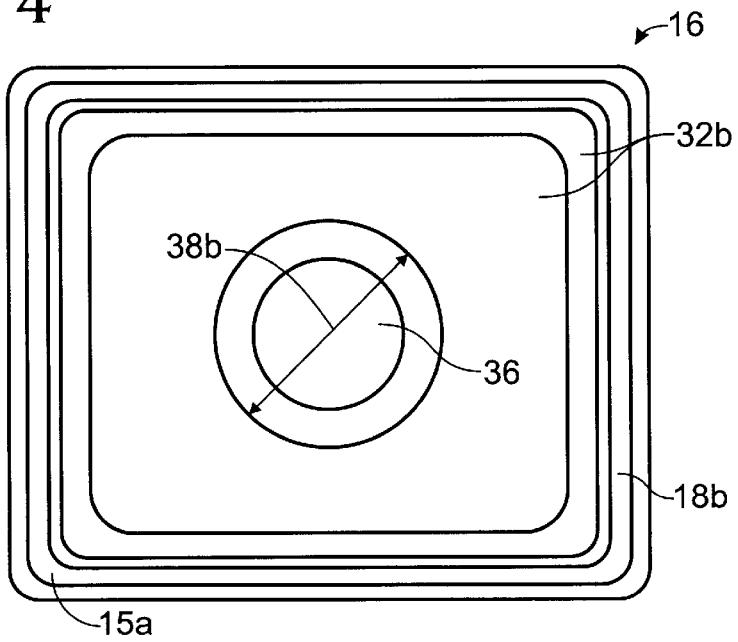
FIG. 4 is top view of a bottom portion of the transportation case of FIG. 1.
Figure 5:
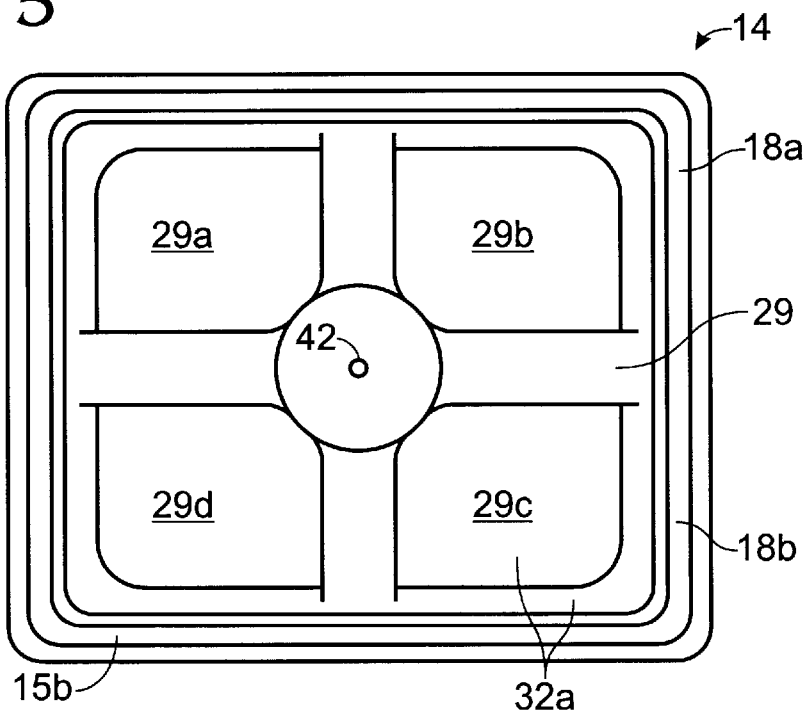
FIG. 5 is a bottom view of a top portion of the transportation case of FIG. 1.

Referring to FIG. 4, the bottom cushion is preferably substantially frusto-conically shaped, so that it has a relatively large base diameter 38*b* nearest the surface 32*b* and has a taper whereby the conical diameter is proportionately reduced with greater distance away from the surface 32*b*. The height, base diameter 38*b* and taper are adapted to suit the heavy object, particularly by fitting partially inside a brake bore 25 when the object 12 is an aircraft brake assembly. An exemplary base diameter 38*b* is about 10" wherein the cushion tapers to about a 6" diameter at about a 3.25" elevation from the bottom 21. Other sizes and tapers of the bottom cushion are contemplated by the invention, as well as differing elevations of the surface 32*b*, for adapting the bottom portion 16 for specific brake assemblies as will be described in OPERATION below.

Referring again to FIG. 1, the top portion 14 preferably includes a top cushion 40 projecting toward the bottom portion 16 when the case 10 is in the closed position 13 Thence, the top cushion projects substantially downwardly from the interior surface 32*a*. The top cushion is advantageously located so that an elongate axis "L2" thereof is substantially in alignment with the axis "L1".

The axis "L2" of the top cushion is preferably disposed so as to be substantially perpendicular to a surface of the heavy object which is contacted thereby. For a substantially rectangular cavity 20*a* employed with an aircraft brake assembly, the axis "L2" of the top cushion is substantially perpendicular to the surface 32*a*. However, other orientations may be desirable for other objects and other case configurations, and may be employed without departing from the principles of the invention.

The top cushion is preferably substantially frusto-conically shaped, so that it has a relatively large base diameter 38*a* nearest the surface 32*a* and has a taper wherein the conical diameter is proportionately reduced with greater distance away from the surface 32*a*. As with the bottom cushion, the height, base diameter 38*a* and taper of the top cushion are adapted to suit the heavy object, particularly by fitting partially inside the brake bore 25 when the object is an aircraft brake assembly. Therefore, the axis "L2" of the top cushion 40 is preferably disposed so as to be in alignment with the axis "L1 " of the bottom cushion 36 when the case 10 is in the closed configuration 13. Preferably, for aircraft brake assemblies, the taper of the top cushion 40 is smaller than is the taper for the bottom cushion 36. An exemplary base diameter 38*a* is about 5.5" wherein the cushion tapers to about a 5.25" diameter at about a 4.5" distance away from the surface 32*a*. Other sizes and tapers of the top cushion are contemplated by the invention, for adapting to particular brake assemblies as will be described in OPERATION below.

The top portion 14 preferably includes a threaded insert 42 embedded in the internal surface 32*a* for receiving a threaded fastener 44 for attaching the top cushion 40. Accordingly, the top cushion 40 has an aperture 35 for receiving the threaded fastener 44 therethrough.

Figure 3:
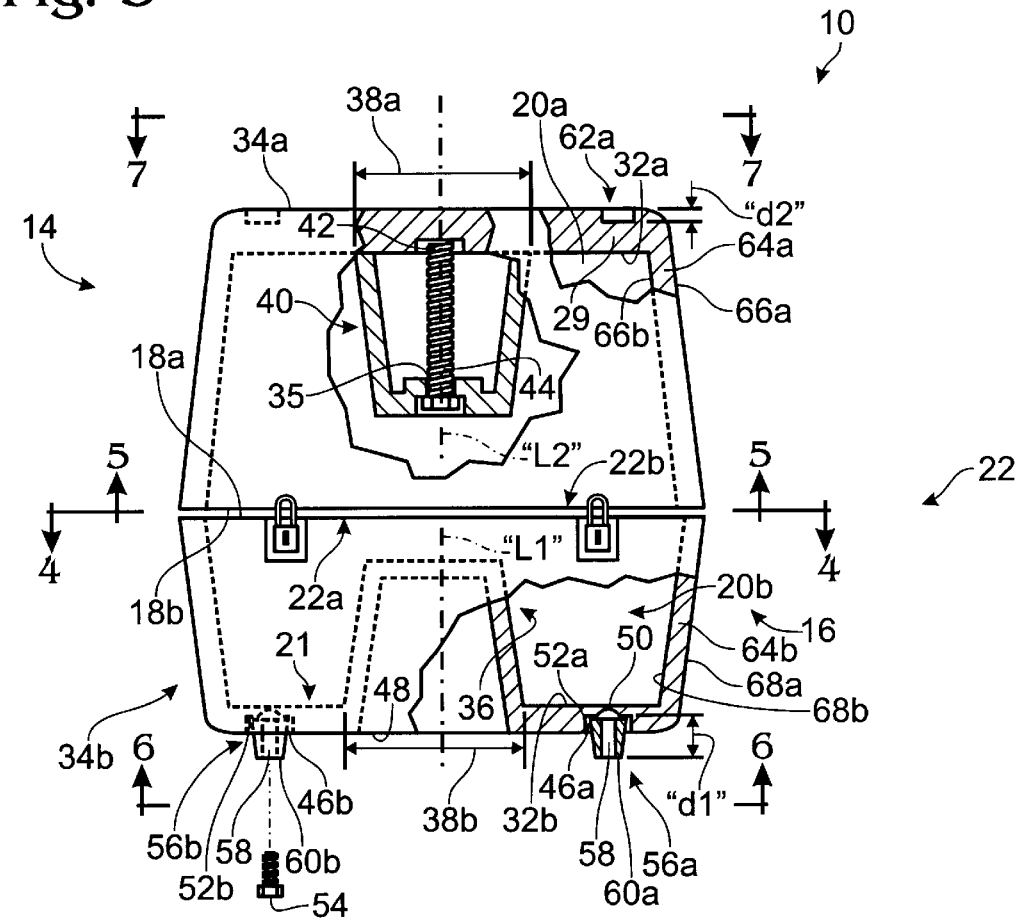
FIG. 3 is a partially cut-away, side elevation of the transportation case of FIG. 1, omitting recesses.

Referring to FIG. 5 and again to FIG. 3, the top portion 14 preferably includes stiffening features, such as ribs 29. In addition to stiffness, the ribs 29 provide wells 29*a*, 29*b*, 29*c* and 29*d* for a protruding portion 11 of the brake assembly 12 to fit therewithin. This facilitates holding the brake assembly 12 in the case 10. For this purpose, the bottom portion 16 is preferably flat, for maximally conforming to a bottom 43 of the brake assembly, also to facilitate holding the brake assembly in the case 10.

Figure 6:
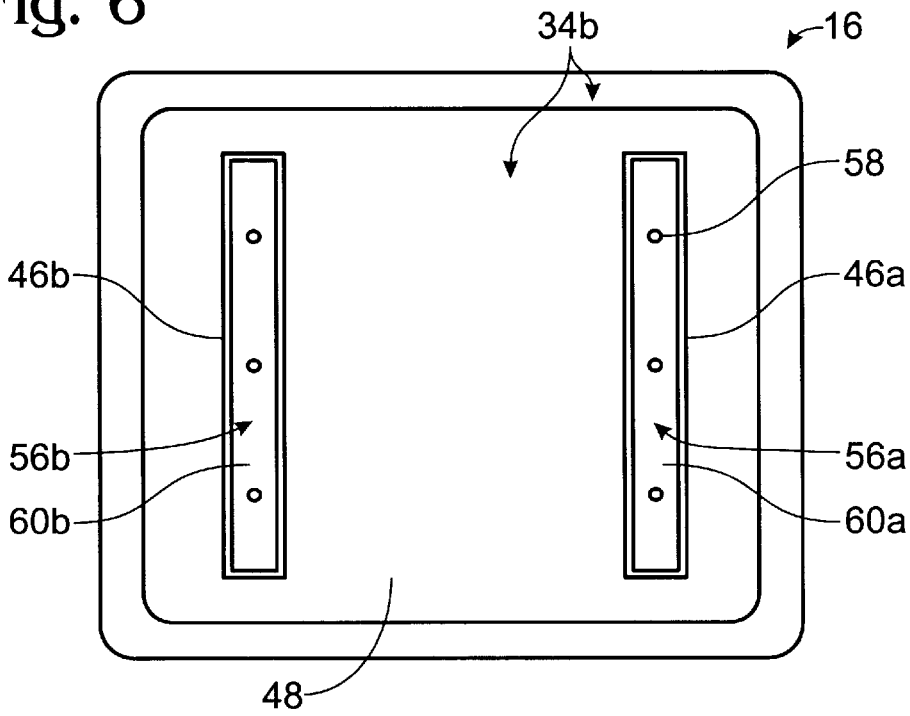
FIG. 6 is a bottom view of the bottom portion of the transportation case of FIG. 1, showing a pair of skids according to the present invention.

Referring to FIG. 6 and again to FIG. 3, the exterior surface 34*b* of the bottom portion 16 includes a pair of spaced apart elongate recesses 46*a*, 46*b* in the bottom 48 of the surface 34*b*. The recesses include threaded inserts 50 in bottom surfaces 52*a*, 52*b* of the recesses, the inserts being for receiving a threaded fastener 54. The recesses are adapted to receive an associated pair of elongate skids 56*a*, 56*b* having apertures 58 therein for receiving the fasteners 54 therethrough. The elongate skids have a depth "d1" sufficient for respective bottom surfaces 60*a*, 60*b* thereof to protrude (the "protrusion") beyond the surface 34*b* when fastened into the recesses 46*a*, 46*b* with the fasteners 54. The bottom surfaces 60*a*, 60*b* form sacrificial wear surfaces for protecting the bottom portion of the case from damage due to sliding the case 10. Thence, the skids 56*a*, 56*b* are adapted to permit removal and replacement when they are exhausted.

Figure 7:
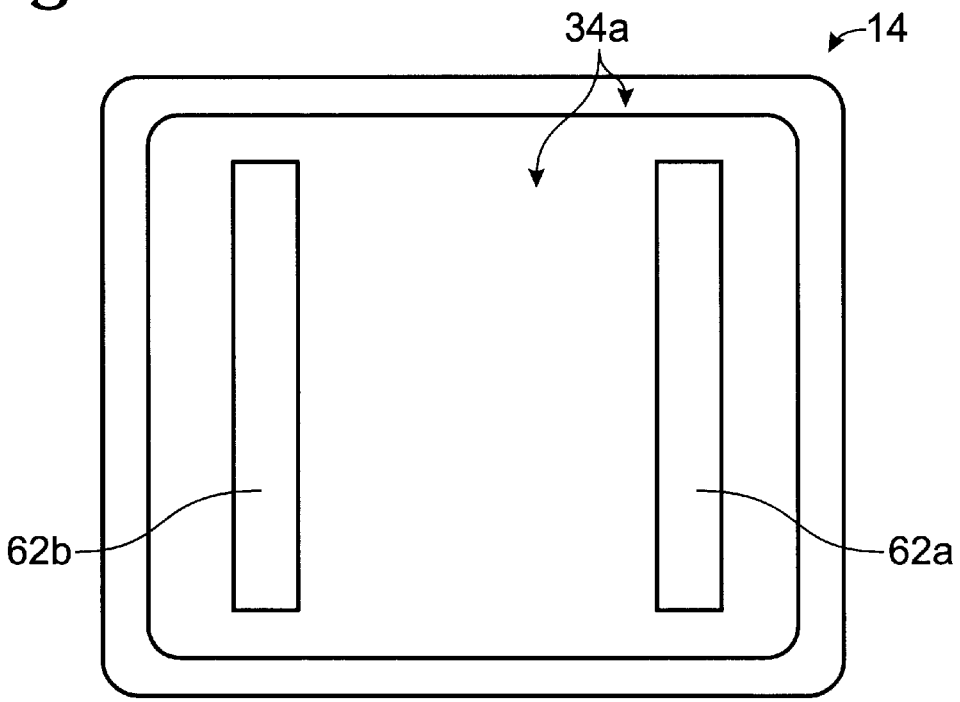
FIG. 7 is a top view of the top portion of the transportation case of FIG. 1.

Referring to FIG. 7 and again to FIG. 3, the exterior surface 34*a* of the top portion 14 includes a pair of spaced apart elongate recesses 62*a*, 62*b* adapted to receive the protruding skids 56*a*, 56*b* attached to another of the cases 10 which is to be stacked on top thereof (the "top" case). The recesses 62*a*, 62*b* have a depth "d2" sufficient for the bottom surfaces 60*a*, 60*b* of the skids to fit therein. Penetration of the skids 56*a*, 56*b* of the top case into the recesses 62*a*, 62*b* of the case 10 prevents relative side-ways movement therebetween and therefore provides for stable stacking of the top case on another case 10. The aforementioned protrusion is advantageously made large enough to permit the entry of the forks of a pallet jack or a forklift between cases which are stacked.

Figure 8:
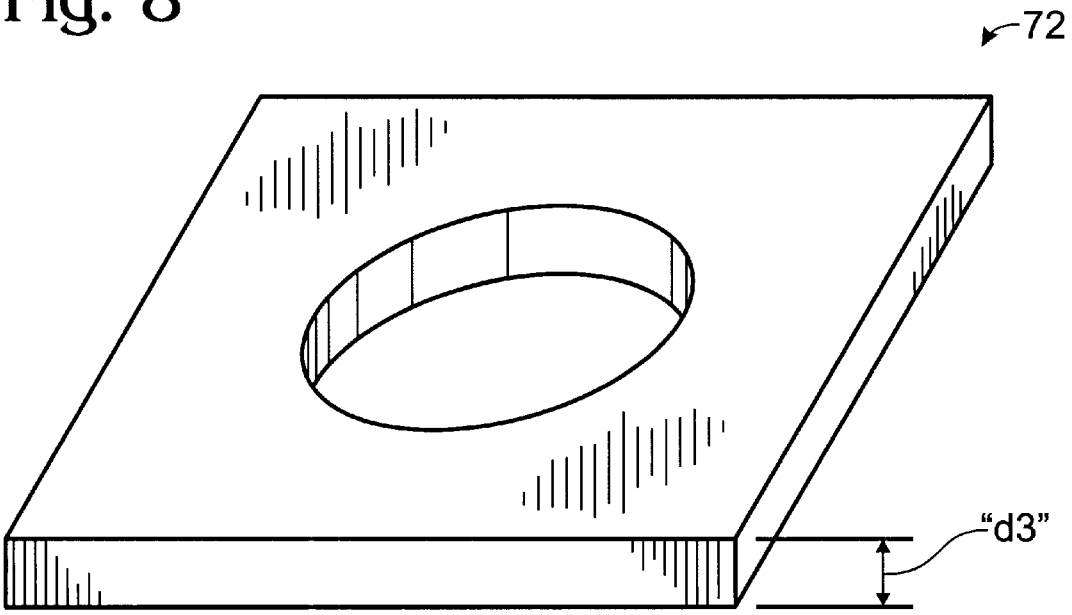
FIG. 8 is a partially cut-away, pictorial view of a spacer according to the present invention for use with the bottom portion of the transportation case of FIG. 1.

Referring to FIG. 8, a spacer 72 may be provided to permit additional flexibility in accommodating different size brake assemblies 12 in modular top and bottom portions. The spacer is adapted to fit over the bottom cushion 36 and lie on the interior surface 32*b* therearound. Thence, the spacer spaces the brake assembly 12 a distance "d3" equal to the depth of the spacer. The spacer may be employed where the aforementioned bottom 21 of the interior surface 32*b* is not elevated substantially with respect to the bottom 48 of the exterior surface 34*b*.

OPERATION

The case 10 may be employed with or without the top cushion 40, depending on the size of the brake assembly to be carried. Particularly, if the outer diameter of the brake assembly 12 is large enough, side-to-side movement of the assembly will be limited by the interior surfaces 32*a*, 32*b* of the case 10, particularly the wells 29*a*, 29*b*, 29*c* or 29*d*. In that case, shear stress on the bottom cushion 36 will be minimized and the top cushion may not be necessary. However, for smaller diameter brake assemblies 12, where side-to-side movement of the assembly will not be limited by the interior surfaces of the case until the assembly moves a substantial amount, shear stress on the bottom cushion 36 will be much larger. Consequently, use of the top cushion 40 is recommended to help locate the assembly in the case 10. Hereinafter, it will be assumed that the top cushion 40 is to be employed. Accordingly, the fastener 44 is inserted through the aperture 35 and screwed into the insert 42 of the top portion 14.

The brake assembly 12 is placed on the bottom cushion 36 so that a first surface 39 of the brake assembly makes contact therewith. The top portion 14 is placed on the bottom portion 16, so that the edges 18*a*, 18*b* are mated in tongue and groove fashion. The top cushion makes contact with a second surface 41 of the brake assembly. It is preferable that the top cushion 40 and the bottom cushion 36 are configured so that the cushions penetrate into the brake assembly 12 sufficiently to stabilize the brake assembly against laterally shifting in the case. The cushions pose minimum risk to internal parts of the brake assembly. The cushions may penetrate any desired amount, including by contacting one another, without departing from the principles of the invention.

An outstanding feature of the transportation case is its modularity. The top portion 14 and the bottom portion 16 are advantageously provided in a single external lateral size, i.e., each has a distinctive length and width that does not change substantially for different top and bottom portions, so that top and bottom portions may be adapted to fit with one another around the circumferential edges 18*a*, 8*b* and so that the different top and bottom portions so adapted are, therefore, modular. Thence, the top portion 14 or the bottom portion 16, or both, may be unclasped from one another and replaced with a different top portion 14, or bottom portion 16, or both. However, the height of the top and bottom portions may be varied to accommodate different sized objects such as aircraft brake assemblies without affecting the modularity of top and bottom portions adapted to fit with one another as aforementioned. In that regard, one advantage of the substantially frusto-conical shape of the bottom cushion and the top cushion is that objects, such as an aircraft brake assembly 12 having different sized apertures therethrough will fit one cushion due to the taper thereof. Consequently, a transportation case with given top and bottom cushions will accept a range of brake assembly sizes.

In addition, the bottom portion 16 intended for a given range of brake assemblies may be provided with a surface 32*b* that is elevated with respect to other bottom portions 16, and may include a bottom cushion 36 that has a different size or has a different taper than the bottom cushion 36 of other bottom portions 16. Similarly, the top cushion 40 may be removed from the top portion 14 and replaced with another top cushion 40 which may have a different size or a different taper than other top cushions 40 and may be selected for a particular brake assembly, for increased flexibility in accommodating different sizes and shapes of brake assemblies.

Further increasing the aforementioned flexibility, the spacer 72 may be employed to space a brake assembly upwardly, toward the top portion 14, as needed. This capability further enhances the modularity of the case 10 by allowing the use of a bottom portion 16 that may otherwise not be well suited to the size or configuration of the brake assembly.

MANUFACTURE

The top portion 14, bottom portion 16, top cushion 40, and skids 56*a*, 56*b* are all preferably formed of cross-linked polyethylene in a closed configuration achieved by rotational molding. That is, the portions, cushion and skids all include a hollow space inside a substantially closed surface. For example, the top portion 14 includes the hollow space 64*a* (filled, as described immediately below) between walls 66*a* and 66*b*. Similarly, the bottom portion 16 includes the hollow space 64*b* between walls 68*a*, 68*b*. The walls 66*a*, 66*b* and 68*a*, 68*b* are preferably substantially about 0.125" thick. The spaces 64*a*, 64*b* are preferably filled with a rigid polyurethane foam 70, injected through tooling apertures (not shown) which have been enlarged for the purpose. Moreover, vents (also not shown) are formed in the walls to permit the foam to fill the spaces as will be readily appreciated by those skilled in the art of plastic molding.

The polyethylene material is advantageously resistant to the brake fluid employed in aircraft brake assemblies. Since the polyurethane material is held in the interior of the portions, it is not important for it to be chemically resistive. Rather, the polyurethane material is employed for improved shock resistance in the portions, by being adapted, as a result of material properties and the foamed configuration, to absorb shock.

The top cushion 40 and skids 56*a*, 56*b* preferably have substantially about 0.25" wall thicknesses in compensation of their, preferably, not being filled with the polyurethane foam. Any of the components may or may not be filled with a plastic foam without departing from the principles of the invention. Moreover, the aforementioned components of the case 10 may be formed in other than closed forms without departing from the principles of the invention. For example, the walls 66*a*, 66*b* could be formed as separately injected molded parts and either joined together thereafter or not.

The spacer 72 may be formed of polyethylene, for example by being expanded or foamed and extruded and laminated on one or both sides with, for example, a polyethylene sheet. Alternatively, the spacer 72 may be formed similarly to the top cushion and skids 56*a*, 56*b* as has been aforedescribed. Other alternative embodiments of the spacer 72 as are readily apparent to those of ordinary skill in the art may be employed without departing from the principles of the invention.

All of the aforementioned components, when worn or nonrestoratively crushed, may all be conveniently and easily replaced. Advantageously, failed plastic parts will visibly signal failure either by cracking or by failing to restore themselves to their original configurations.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

We claim:

1. A transportation case for an aircraft brake assembly, comprising:

a first part forming a cavity having an interior surface comprising a central portion and a wall portion and having a substantially frusto-conically shaped first cushion projecting from said central portion into said cavity; and a second part having a circumferential edge that substantially matches a corresponding circumferential edge of said first part, and an interior surface comprising a central portion and a wall portion and having a substantially frusto-conically shaped second cushion projecting from said central portion of said second part into said cavity of said second part, wherein said first and second parts include spaced apart walls formed of a first material adapted to resist brake fluid, said walls containing therebetween a second material adapted to absorb shock, said first and second parts being cooperatively adapted so that, with said second part receiving a side of the aircraft brake assembly so that said second cushion penetrates an aperture therein and said circumferential edges brought together to form an enclosure for the aircraft brake assembly, said first cushion is disposed to penetrate an aperture in an opposite side of the aircraft brake assembly to stabilize the aircraft brake assembly against shifting in the case during shipping.

2. The transportation case of claim 1, wherein said circumferential edges are adapted to mate with one another in tongue and groove fashion substantially along their entire lengths.

3. The transportation case of claim 1, wherein each of said circumferential edges lies substantially in and thereby defines a single respective plane.

4. The transportation case of claim 1, wherein said first cushion is removably attached to said first part.

5. The transportation case of claim 1, further comprising a spacer disposed around said second cushion to space the object a predetermined distance toward said first part.

6. The transportation case of claim 1, wherein, when said circumferential edges are brought together, said edges are biased toward said second part of the transportation case.

7. The transportation case of claim 1, wherein said walls comprise a first plastic material.

8. The transportation case of claim 7, wherein said first plastic material is polyethylene.

9. The transportation case of claim 1, wherein said material between said walls comprises a second plastic material.

10. The transportation case of claim 9, wherein said second plastic material is a rigid polyurethane foam.

11. The transportation case of claim 1, wherein said second part includes an exterior surface for removably receiving a replaceable wearing member, said wearing member being adapted to protrude beyond said exterior surface when said wearing member is attached to said exterior surface.

12. The transportation case of claim 11, wherein said first part includes an exterior surface having a top recess adapted to receive said wearing member when said wearing member is installed on a like transportation case which is stacked on top of the transportation case.

13. A method for transporting a heavy object having an aperture therethrough, comprising:

providing a transportation case having a first portion adapted for engaging the top of the object;

providing a plurality of second portions of the transportation case, each of said second portions being adapted to matingly fit said first portion to form a closed configuration of the case, each of said second portions having an associated, substantially frusto-conically shaped second cushion extending from an interior surface thereof toward said first portion when said second portion is mated to said first portion;

selecting from among said plurality of second portions a selected second portion having an associated second cushion for which the side thereof is adapted to fit within and contact the periphery of the object, said first portion being adapted to force the periphery of the aperture against the side of said associated second cushion for engaging a second end of the object;

receiving said second end of the object by said associated second cushion; and matingly fitting said first portion to said selected second portion to form a closed configuration of the case, thereby automatically securing the object therebetween.

14. The method of claim 13, wherein the first heavy object is replaced with a second heavy object, the method further comprising the steps of removing said selected second portion and replacing said selected second portion with another selected second portion, said other selected second portion being adapted to matingly fit with said first portion, said other selected second portion being selected so that its associated second cushion is adapted to fit within and contact the periphery of an aperture in the second object when said first portion is mated to said other selected second portion, wherein said interior surface of said other selected second portion is at a different elevation than said interior surface of said selected second portion, and wherein the exterior lateral size and shape of said second other selected second portion is substantially the same as the exterior lateral size and shape of said selected second portion.

15. The method of claim 13, wherein the first heavy object is replaced with a second heavy object, the method further comprising the steps of removing said selected second portion and replacing said selected second portion with another selected second portion, said other selected second portion being adapted to matingly fit with said first portion, said second portion being selected so that its associated second cushion is adapted to fit within and contact the periphery of an aperture in the second object when said first portion is mated to said other selected second portion, wherein the said second cushion associated with said other selected second portion has a different size than the said second cushion associated with said selected second portion, and wherein the exterior lateral size and shape of said second other selected second portion is substantially the same as the exterior lateral size and shape of said selected second portion.

16. The method of claim 13, wherein the first heavy object is replaced with a second heavy object, the method further comprising the steps of removing said selected second portion and replacing said selected second portion with another selected second portion, said other selected second portion being adapted to matingly fit with said first portion, said other selected second portion being selected so that its associated second cushion is adapted to fit within and contact the periphery of an aperture in the second object when said first portion is mated to said other selected second portion, wherein the said second cushion associated with said other selected second portion has a different taper than the said second cushion associated with said selected second portion, and wherein the exterior lateral size and shape of said second other selected second portion is substantially the same as the exterior lateral size and shape of said selected second portion.

17. A method of packaging a first heavy object, comprising the steps of:

providing a bottom portion of a transportation case;

providing a top portion of said transportation case, said top portion being adapted to matingly fit with said bottom portion and being adapted to receive one of a plurality of substantially frusto-conically shaped top cushions so as to extend from an interior surface thereof toward said bottom portion selecting a first top cushion from said plurality of top cushions so that said first top cushion is disposed to fit within and contact the periphery of an aperture in the first object when said top portion is mated to said bottom portion;

placing the first object in said bottom portion; and matingly fitting said top portion to said bottom portion, to form a closed configuration of said transportation case.

18. The method of claim 17, further comprising the step of replacing said first top cushion with a substantially frusto-conically shaped second top cushion having a different lateral size than that of said first top cushion.

19. The method of claim 18, further comprising the step of replacing said first top cushion with a substantially frusto-conically shaped second top cushion having a different taper than that of said first top cushion.

20. A method of packaging a first heavy object, comprising the steps of:

providing a top portion of a transportation case;

providing a plurality of bottom portions for said transportation case, said bottom portions each including respective substantially frusto-conically shaped bottom cushions extending upwardly from respective interior surfaces thereof;

selecting a first bottom portion of said plurality of bottom portions so that the respective said bottom cushion is disposed to fit within and contact the periphery of an aperture in the first object when said top portion is mated to said first bottom portion;

placing the first object in said bottom portion so that said aperture is disposed over the respective said bottom cushion; and matingly fitting said top portion to said first bottom portion, to form a closed configuration of said transportation case.

21. The method of claim 20, further comprising the step of replacing said first bottom portion with a second bottom portion, said second bottom portion having a substantially frusto-conically shaped second bottom cushion having a different lateral size than that of said first bottom cushion.

22. The method of claim 20, further comprising the step of replacing said first bottom portion with a second bottom portion, said second bottom portion having a substantially frusto-conically shaped second bottom cushion having a different taper than that of said first bottom cushion.

23. The method of claim 20, further comprising the step of providing a spacer having an aperture therethrough and placing said spacer over said first bottom cushion so that said first bottom cushion extends through said aperture, for increasing the modularity of said transportation case.

24. A method of packaging a first heavy object, comprising the steps of:

providing a bottom portion of a transportation case;

providing a plurality of top portions for said transportation case, said top portions each including respective substantially frusto-conically shaped first top cushions extending upwardly from respective interior surfaces thereof;

selecting one of said plurality of top portions so that said respective top cushion is provided to fit within and contact the periphery of an aperture in the first object when said bottom portion is mated to said top portion;

placing the first object in said bottom portion; and matingly fitting said top portion to said bottom portion, to form a closed configuration of said transportation case.

25. The method of claim 24, further comprising the step of replacing said first top portion with a second top portion, said second top portion having a substantially frusto-conically shaped second top cushion having a different lateral size than that of said first top cushion.

26. The method of claim 24, further comprising the step of replacing said first top portion with a second top portion, said second top portion having a substantially frusto-conically shaped second bottom cushion having a different taper than that of said first top cushion.

* * * * *